US009665114B2

(12) United States Patent
Luo et al.

(10) Patent No.: US 9,665,114 B2
(45) Date of Patent: May 30, 2017

(54) REGULATOR APPLIED ON OUTPUT TERMINAL OF POWER SOURCE TO ADJUST ADJUSTING CURRENT FOR INCREASING REFERENCE VOLTAGE WHEN SENSING DECREASE OF REFERENCE VOLTAGE AND DECREASING REFERENCE VOLTAGE WHEN SENSING INCREASE OF REFERENCE VOLTAGE AND REGULATING METHOD

(71) Applicant: MEDIATEK INC., Hsin-Chu (TW)

(72) Inventors: Yan-Bin Luo, Taipei (TW); Chih-Chien Hung, Hualien County (TW)

(73) Assignee: MEDIATEK INC., Hsin-Chu (TW)

( * ) Notice: Subject to any disclaimer, the term of this patent is extended or adjusted under 35 U.S.C. 154(b) by 96 days.

(21) Appl. No.: 14/043,859

(22) Filed: Oct. 2, 2013

(65) Prior Publication Data

US 2015/0091540 A1 Apr. 2, 2015

(51) Int. Cl.

*G05F 1/59* (2006.01)
*G05F 1/56* (2006.01)
*G05F 1/46* (2006.01)

(52) U.S. Cl.

CPC ..... *G05F 1/59* (2013.01); *G05F 1/46* (2013.01); *G05F 1/56* (2013.01)

(58) Field of Classification Search

CPC ..... G05F 1/59
USPC ..... 323/272, 273, 315, 316
See application file for complete search history.

(56) References Cited

U.S. PATENT DOCUMENTS 5,343,383 A * 8/1994 Shinada ..... H02M 3/33592 363/127
6,064,267 A * 5/2000 Lewyn ..... G05F 3/262 323/315
2003/0071675 A1* 4/2003 Stair et al. ..... 327/356
2005/0068266 A1* 3/2005 Sano ..... G09G 3/296 345/60
2005/0161700 A1* 7/2005 Bayer ..... H03K 17/08122 257/139
2005/0195020 A1* 9/2005 Matsushita ..... G05F 1/56 327/541
2008/0067991 A1* 3/2008 Lee ..... G05F 1/575 323/273
2009/0160557 A1* 6/2009 Luzzi et al. ..... 330/288
2009/0315595 A1* 12/2009 Nakagawa ..... 327/109
2012/0212260 A1* 8/2012 Chen ..... H03K 17/163 327/108

(Continued)

FOREIGN PATENT DOCUMENTS

CN 101999105 A 3/2011
CN 102955491 A 3/2013

*Primary Examiner* — Jue Zhang
*Assistant Examiner* — Trinh Dang
(74) *Attorney, Agent, or Firm* — Winston Hsu; Scott Margo

(57) ABSTRACT

A regulator applied to regulate a first reference voltage on an output terminal, the regulator includes: a sensing circuit, arranged to sense a variation of the first reference voltage on the output terminal to generate a sensing signal; and a gain stage, arranged to provide an adjusting current to the output terminal in response to the sensing signal for reducing the variation of the first reference voltage, and the gain stage is coupled in parallel to a loading circuit powered by the first reference voltage.

21 Claims, 4 Drawing Sheets

(56) References Cited

U.S. PATENT DOCUMENTS

| | | | | |
|---|---|---|---|---|
| 2012/0280271 | A1* | 11/2012 | Ichikawa | 257/133 |
| 2013/0221943 | A1* | 8/2013 | Baker et al. | 323/312 |
| 2013/0234687 | A1 | 9/2013 | Fujimura | |

* cited by examiner

REGULATOR APPLIED ON OUTPUT TERMINAL OF POWER SOURCE TO ADJUST ADJUSTING CURRENT FOR INCREASING REFERENCE VOLTAGE WHEN SENSING DECREASE OF REFERENCE VOLTAGE AND DECREASING REFERENCE VOLTAGE WHEN SENSING INCREASE OF REFERENCE VOLTAGE AND REGULATING METHOD

BACKGROUND

The present invention relates to a voltage regulator and the related regulating method, and more particularly to a high speed and low cost voltage regulator, and the related regulating method.

In a system having multi-circuit blocks, a voltage regulator may be used to provide a supply voltage to the multi-circuit blocks according to an output voltage provided by a power source. Therefore, the voltage regulator should be able to provide currents to the multi-circuit blocks while keep the supply voltage intact during the operation of one or more of the multi-circuit blocks. For example, a low dropout (LDO) regulator having low-dropout between the output voltage of the power source and the supply voltage is commonly used to provide the power for the multi-circuit blocks coupled thereto. However, for the circuit device fabricated under the modern semiconducting process, the operation voltage of the system is low. Then, there may not have enough room, i.e. the so called headroom, for the voltage dropout between the LDO regulator and the circuit block. Moreover, the conventional LDO regulator normally comprises two stages, and it is well-known that a two stage system always suffers from the stability problem. In other words, the conventional LDO regulator may not be a stable system during the high speed operation.

Another example to provide a stable supply voltage to the multi-circuit blocks is to use a large capacitor to connect to the output node of the power source in order to become a charges pool at the output node of the power source. However, this may occupy large chip area of the circuit system if the capacitor is an on-chip capacitor; and if the capacitor is an off-chip capacitor, the bond wire of the off-chip capacitor may become an inductive element under the high frequency. Therefore, using a large capacitor as a charges pool at the output node of the power source is also not a good solution to provide a stable supply voltage to the multi-circuit blocks.

Accordingly, providing a novel voltage regulator to solve the headroom problem and the high frequency problem of the conventional regulator is an urgent problem in this field.

SUMMARY

One of the objectives of the present embodiments is to provide a high speed and low cost voltage regulator, and the related regulating method.

According to a first embodiment of the present invention, a regulator is disclosed. The regulator is applied to regulate a first reference voltage on an output terminal. The regulator comprises a sensing circuit and a gain stage. The sensing circuit is arranged to sense a variation of the first reference voltage on the output terminal to generate a sensing signal. The gain stage is arranged to provide an adjusting current to the output terminal in response to the sensing signal for reducing the variation of the first reference voltage, and the gain stage is coupled in parallel to a loading circuit powered by the first reference voltage.

According to a second embodiment of the present invention, a regulating method provided. The regulating method is applied to regulate a first reference voltage on an output terminal. The regulating method comprises the step of: sensing a variation of the first reference voltage on the output terminal to generate a sensing signal; and using a gain stage for providing an adjusting current to the output terminal in response to the sensing signal for reducing the variation of the first reference voltage, and the gain stage is coupled in parallel to a loading circuit powered by the first reference voltage.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
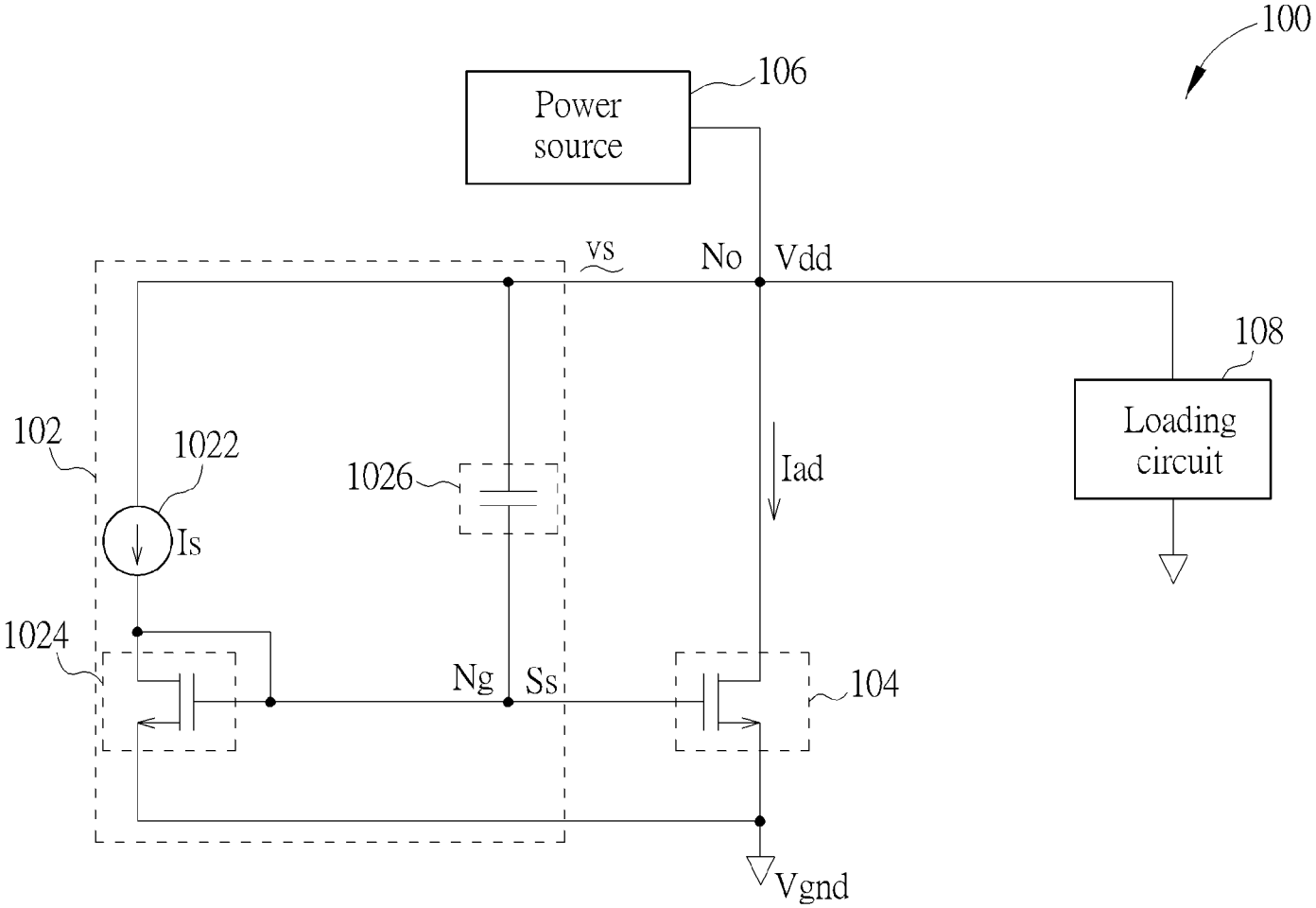
FIG. 1 is a diagram illustrating a regulator applied to regulate a first reference voltage on an output terminal according to a first embodiment of the present invention.

Please refer to FIG. 1, which is a diagram illustrating a regulator 100 applied to regulate a first reference voltage Vdd, which is a supply voltage of a functional circuit block, on an output terminal No according to a first embodiment of the present invention. The regulator 100 comprises a sensing circuit 102 and a compensation circuit comprising a gain stage 104. The sensing circuit 102 is arranged to sense a variation vs of the first reference voltage Vdd on the output terminal No to generate a sensing signal Ss. The gain stage 104 is arranged to provide an adjusting current Iad to the output terminal No in response to the sensing signal Ss for reducing the variation vs of the first reference voltage Vdd. The first reference voltage Vdd is an output voltage provided by a power source. More specifically, the output terminal No is directly coupled to the power source for receiving the first reference voltage outputted by the power source, and the regulator 100 is directly connected to the output terminal (i.e. No) of the power source. Moreover, the output terminal No is also an output port for providing the first reference voltage Vdd or output power to a loading circuit. Accordingly, for clarity, a power source 106 and a loading circuit 108 are also shown in FIG. 1.

According to the present embodiment, the sensing circuit 102 comprises a current source 1022, a diode-connected transistor 1024, and a capacitive circuit 1026. The current source 102 has a first terminal directly coupled to the output terminal No for generating a reference current Is. The diode-connected transistor 1024 has a drain terminal coupled to a second terminal of the current source 1022 to receive the reference current Is, and a source terminal coupled to a second reference voltage Vgnd, which is a ground voltage. The capacitive circuit 1026 has a first terminal directly coupled to the output terminal No, and a second terminal directly coupled to a gate terminal Ng of the diode-connected transistor 1024. It is noted that the drain terminal of the diode-connected transistor 1024 is coupled to the gate terminal Ng of the diode-connected transistor 1024, and the sensing signal Ss is generated at the gate terminal Ng of the diode-connected transistor 1024. In this embodiment, the diode-connected transistor 1024 is an N-type field-effected transistor (FET).

In addition, the gain stage 104 comprises an N-type FET, which has a gate terminal coupled to the gate terminal Ng of the diode-connected transistor 1024 to receive the sensing signal Ss, a drain terminal directly coupled to the output terminal No, and a source terminal coupled to the second reference voltage Vgnd.

According to the present embodiment, the sensing circuit 102 can be regarded as a high pass filter connecting between the output terminal No and the gate terminal Ng of the diode-connected transistor 1024, and the gain stage 104 can be regarded as a trans-conducting circuit (i.e. gm cell) for converting the sensing signal Ss in a way of voltage form into a current signal (i.e. the adjusting current Iad). Please refer to FIG. 1 again, if the loading circuit 108 draws a large current from the power source 106, then the variation vs may be induced at the output terminal No. The variation vs can be regarded as a small voltage signal that may vary the effective reference voltage Vdd on the output terminal No. If the variation vs is large enough, the functional circuit blocks (not shown) that receive the first reference voltage Vdd as the supply voltage may be affected by the effective reference voltage Vdd. Therefore, the sensing circuit 102 having the characteristic of high pass filtering is arranged to sense the variation vs on the output terminal No to accordingly generate the sensing signal Ss.

More specifically, the current source 1022 in conjunction with the diode-connected transistor 1024 can be regarded as a bias generator of the gain stage 104, and the capacitive circuit 1026 is arranged to pass the high frequency variation vs to the gate terminal Ng of the diode-connected transistor 1024. Therefore, the capacitive circuit 1026 is designed to have much larger capacitance than the parasitic capacitor at the gate terminal Ng of the diode-connected transistor 1024. For example, the capacitance of the capacitive circuit 1026 may be at least 10 times larger than the capacitance of the parasitic capacitor at the gate terminal Ng. In other words, the loop comprising the capacitive circuit 1026 and the gain stage 104 is a one-stage negative feedback loop. More specifically, when the voltage at the output terminal No is decrease, the voltage at the gate terminal Ng is also decrease, and the current drawn from the output terminal No is decrease for increasing the voltage at the output terminal No, and vice versa. Moreover, as the regulator 100 is a one-stage negative feedback loop, the regulator 100 can be operated under very high frequency without entering the instable state. The regulator 100 also occupies small chip area.

In addition, as the regulator 100 and the loading circuit 108 are coupled in parallel (e.g. between the output terminal No and the ground Vgnd), the loading circuit 108 directly receives the first reference voltage Vdd provided by the power source 106, there is no headroom problem for the regulator 100. Therefore, the regulator 100 is more suitable in using in the circuit device fabricated under the modern semiconducting process, which has the low operation voltage. Moreover, in this embodiment, the loading circuit 108 and the functional circuit blocks (not shown) connecting to the output terminal No are the core device in the circuit system, which means that the first reference voltage Vdd being regulated by the regulator 100 is a core voltage of the circuit system, wherein the core voltage is normally smaller than an I/O (Input/Output) voltage, the I/O voltage is the voltage transmitted between different chips, and the core voltage is the voltage transmitted between different circuit blocks in a single chip. Furthermore, in comparison with a FET implemented as an I/O device, a FET implemented as a core device has a breakdown voltage smaller than the breakdown voltage of the FET implemented as the I/O device. Therefore, in this embodiment, the N-type FETs in the gain stage 104 and the sensing circuit 102 are implemented as the core device of the circuit system because the first reference voltage Vdd is the core voltage in the circuit system.

Moreover, when there is a high frequency variation vs occurs on the output terminal No, and when the high pass filter (i.e. the sensing circuit 102) passes the high frequency variation vs to the gate terminal Ng, the high pass filter (i.e. the sensing circuit 102) actually acts as an impedance circuit. In this embodiment, the impedance circuit is designed to have a low impedance in order to lower the voltage variation between the output terminal No and the second reference voltage Vgnd when the high frequency variation vs occurs.

Figure 2:
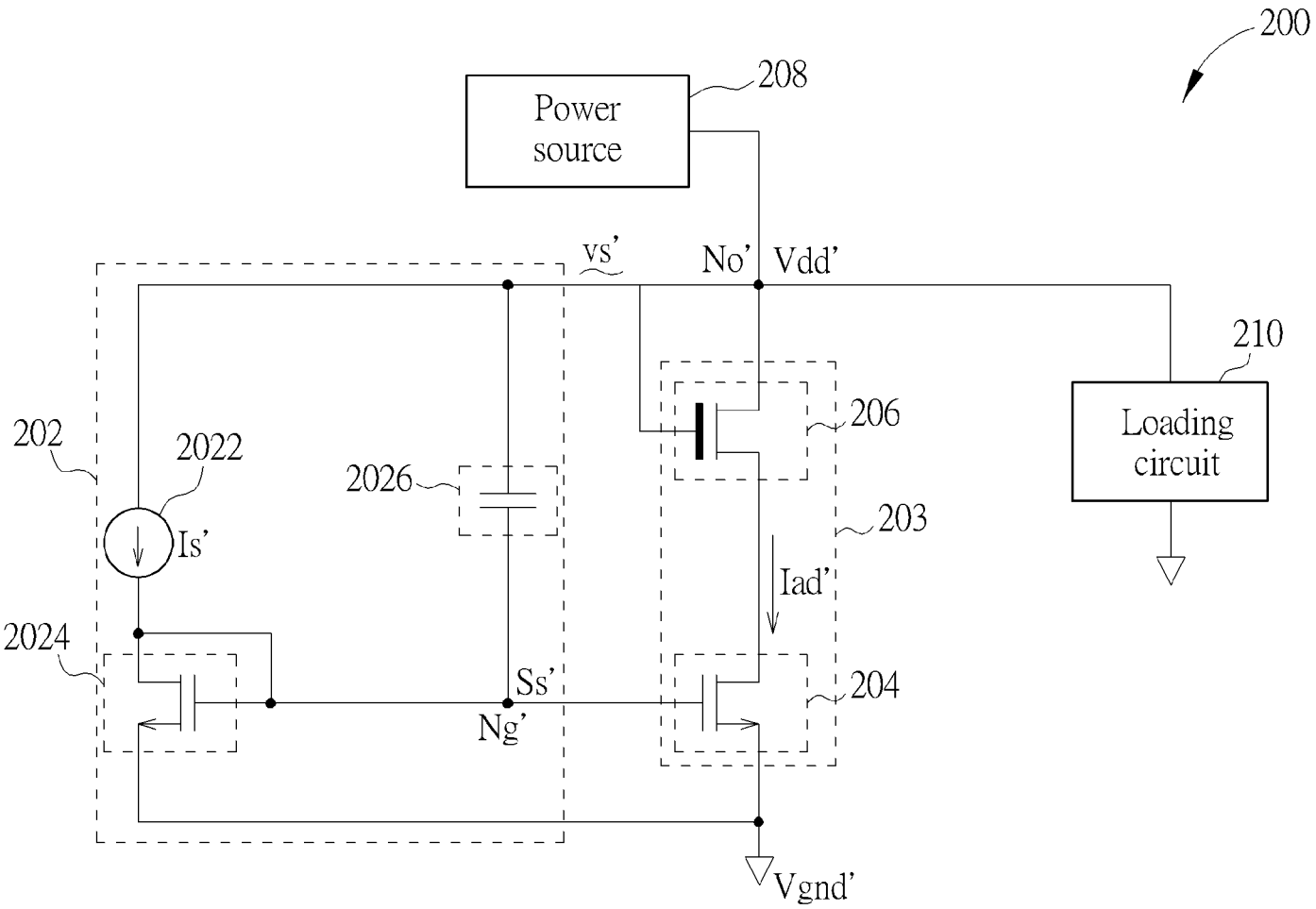
FIG. 2 is a diagram illustrating a regulator applied to regulate a first reference voltage on an output terminal according to a second embodiment of the present invention.

Please refer to FIG. 2, which is a diagram illustrating a regulator 200 applied to regulate a first reference voltage Vdd', which is a supply voltage of a functional circuit block, on an output terminal No' according to a second embodiment of the present invention. The regulator 200 comprises a sensing circuit 202 and a gain stage 203. The sensing circuit 202 is arranged to sense a variation vs' of the first reference voltage Vdd' on the output terminal No' to generate a sensing signal Ss'. The gain stage 203 comprises a gm-cell 204, and further comprises a protection circuit 206. The gm-cell 204 is arranged to provide an adjusting current Iad' to the output terminal No' in response to the sensing signal Ss' for reducing the variation vs' of the first reference voltage Vdd'. The protection circuit 206 is coupled between the gm-cell 204 and the output terminal No' for inducing a voltage drop between the output terminal No' and the gm-cell 204. The first reference voltage Vdd' is an output voltage provided by a power source. More specifically, the regulator 200 is directly connected to the output terminal (i.e. No') of the power source. Moreover, the output terminal No' is also an output port for providing the first reference voltage Vdd' or output power to a loading circuit. Accordingly, for clarity, a power source 208 and a loading circuit 210 are also shown in FIG. 2.

According to the present embodiment, the sensing circuit 202 comprises a current source 2022, a diode-connected transistor 2024, and a capacitive circuit 2026. The current source 202 has a first terminal directly coupled to the output terminal No' for generating a reference current Is'. The diode-connected transistor 2024 has a drain terminal coupled to a second terminal of the current source 2022 to receive the reference current Is', and a source terminal coupled to a second reference voltage Vgnd', which is a ground voltage . The capacitive circuit 2026 has a first terminal directly coupled to the output terminal No', and a second terminal directly coupled to a gate terminal Ng' of the diode-connected transistor 2024. It is noted that the drain terminal of the diode-connected transistor 2024 is coupled to the gate terminal Ng' of the diode-connected transistor 2024, and the sensing signal Ss' is generated at the gate terminal Ng' of the diode-connected transistor 2024. In this embodiment, the diode-connected transistor 2024 is an N-type field-effected transistor (FET).

In addition, the gm-cell 204 comprises an N-type FET, which has a gate terminal coupled to the gate terminal Ng' of the diode-connected transistor 2024 to receive the sensing signal Ss', a drain terminal coupled to the output terminal No', and a source terminal coupled to the second reference voltage Vgnd'.

Moreover, the protection circuit 206 comprises an N-type FET, which has a gate terminal directly coupled to the output terminal No', a drain terminal directly coupled to the output terminal No', and a source terminal coupled to the gm-cell 204. More specifically, the source terminal of the N-type FET of the protection circuit 206 is connected to the drain terminal of the N-type FET of the gm-cell 204.

In the second embodiment, the operations of the sensing circuit 202 and the gm-cell 204 are similar to the operations of the sensing circuit 102 and the gm-cell 104, thus the detailed descriptions of the sensing circuit 202 and the gm-cell 204 are omitted here for brevity. The difference between the regulator 200 and the regulator 100 is the additional protection circuit 206. In the second embodiment, the protection circuit 206 is implemented as the I/O device, and the sensing circuit 202 and the gm-cell 204 are implemented as the core device. Moreover, the regulator 200 and the loading circuit 210 are implemented as two different chips, thus the first reference voltage Vdd' being regulated by the regulator 200 is an I/O voltage of the circuit system. As the I/O voltage may higher than the core voltage, the N-type FET of the protection circuit 206 that is implemented as the I/O device can provide a voltage drop between the output terminal No' and the drain terminal of the N-type FET of the gm-cell 204, wherein the N-type FET of the gm-cell 204 and the diode-connected transistor 2024 are implemented by the core device. Therefore, by introducing the voltage drop between the output terminal No' and the drain terminal of the N-type FET of the gm-cell 204, the voltage on the drain terminal of the N-type FET of the gm-cell 204 is decrease accordingly. Therefore, the N-type FET of the gm-cell 204 can be avoided from breaking down due to the high I/O voltage on the output terminal No'. In other words, to protect the N-type FET of the gm-cell 204, the N-type FET of the gm-cell 204 is arranged to not directly coupled to the I/O terminal, i.e. No'.

It should be noted that, in the second embodiment, the loop comprising the capacitive circuit 2026, the gm-cell 204, and the protection circuit 206 is also a one-stage negative feedback loop. Therefore, the regulator 200 can be operated under very high frequency without entering the instable state, and the regulator 200 also occupies small chip area. Moreover, as the regulator 200 and the loading circuit 310 are directly connected to the same terminal (i.e. the output terminal No') for receiving the first reference voltage Vdd', there is no headroom problem for the regulator 200. In addition, when there is a high frequency variation vs' occurs on the output terminal No', the high pass filter (i.e. the sensing circuit 202) also acts as an low impedance circuit, thus the voltage variation between the output terminal No and the second reference voltage Vgnd can be decreased when the high frequency variation vs' occurs at the output terminal No'.

Please noted that, even though the above embodiments implemented based on N-type FET, this is not a limitation of the present invention. Another embodiments implemented based on P-type FET also belongs to the scope of the present invention.

Figure 3:
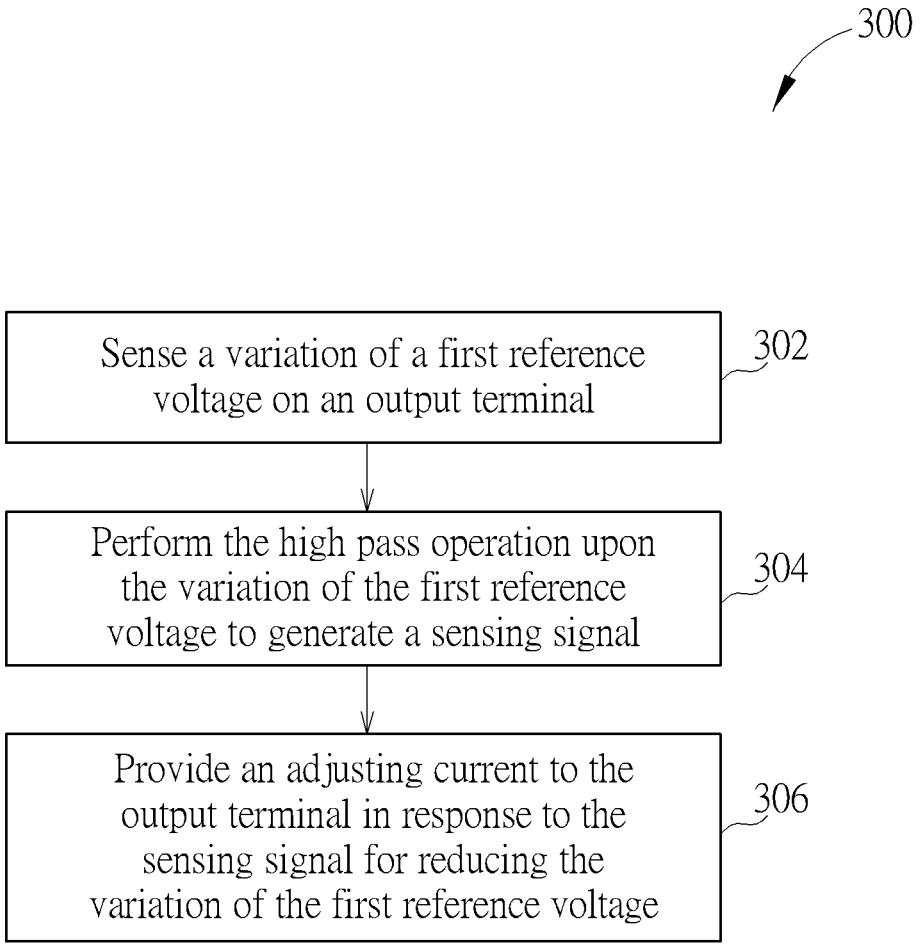
FIG. 3 is a flowchart illustrating a regulating method applied to regulate a first reference voltage on an output terminal according to a third embodiment of the present invention.

The operation of the first embodiment regulator 100 can be briefly illustrated by the steps in FIG. 3, which is a flowchart illustrating a regulating method 300 applied to regulate the first reference voltage Vdd on the output terminal No according to a third embodiment of the present invention. Provided that substantially the same result is achieved, the steps of the flowchart shown in FIG. 3 need not be in the exact order shown and need not be contiguous, that is, other steps can be intermediate. The regulating method comprising:

Step 302: Sense the variation vs of the first reference voltage Vdd on the output terminal No;

Step 304: Perform the high pass operation upon the variation vs of the first reference voltage Vdd to generate the sensing signal Ss; and Step 306: Use the gain stage 104 for providing the adjusting current Iad to the output terminal No in response to the sensing signal Ss for reducing the variation vs of the first reference voltage Vdd, and the gain stage 104 is coupled in parallel to the loading circuit 108 powered by the first reference voltage Vdd.

Figure 4:
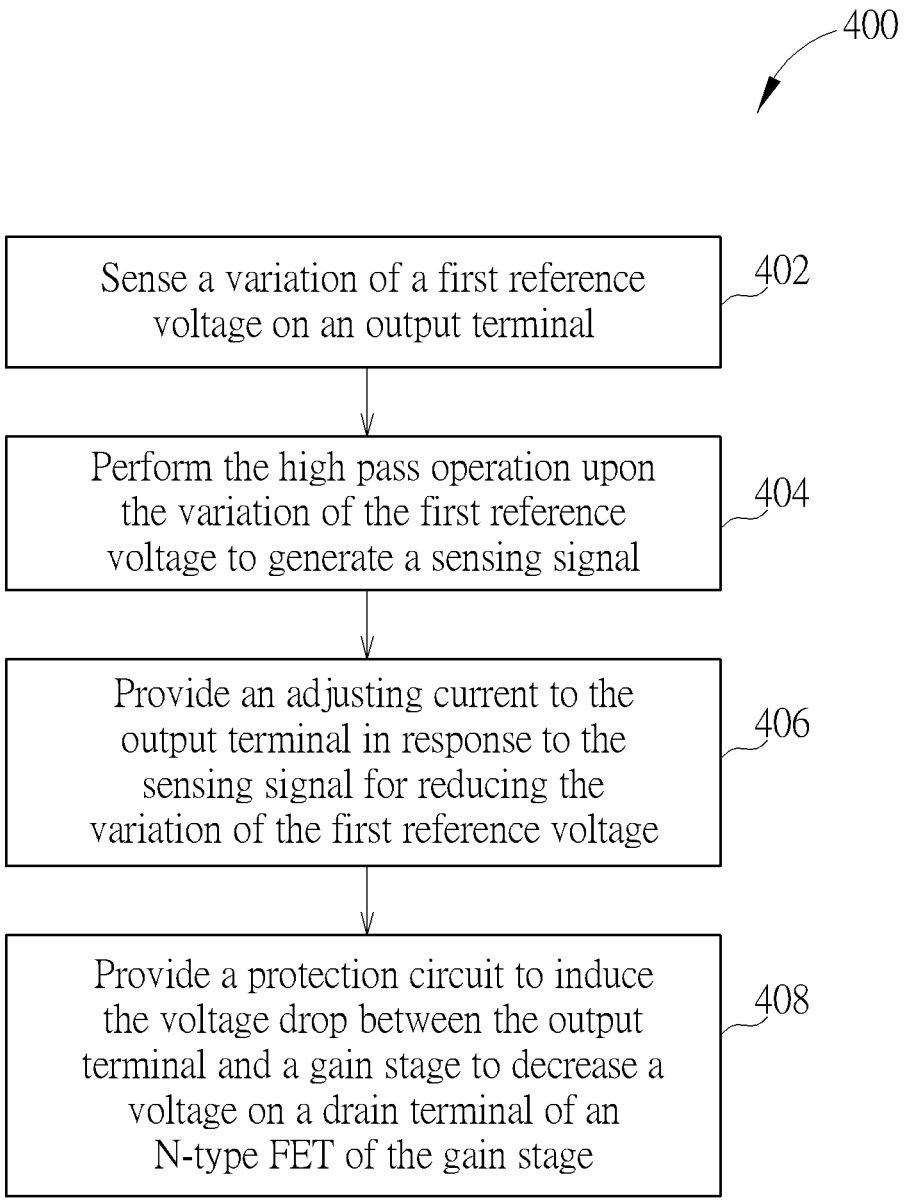
FIG. 4 is a flowchart illustrating a regulating method applied to regulate a first reference voltage on an output terminal according to a fourth embodiment of the present invention.

Moreover, the operation of the first embodiment regulator 200 can be briefly illustrated by the steps in FIG. 4, which is a flowchart illustrating a regulating method 400 applied to regulate the first reference voltage Vdd' on the output terminal No' according to an embodiment of the present invention. Provided that substantially the same result is achieved, the steps of the flowchart shown in FIG. 4 need not be in the exact order shown and need not be contiguous, that is, other steps can be intermediate. The regulating method comprising:

Step 402: Sense the variation vs' of the first reference voltage Vdd' on the output terminal No';

Step 404: Perform the high pass operation upon the variation vs' of the first reference voltage Vdd' to generate the sensing signal Ss';

Step 406: Provide the adjusting current Iad' by the gm-cell 204 to the output terminal No' in response to the sensing signal Ss' for reducing the variation vs' of the first reference voltage Vdd'; and Step 408: Provide the protection circuit 206 to induce the voltage drop between the output terminal No' and the gm-cell 204 to decrease the voltage on the drain terminal of the N-type FET of the gm-cell 204.

Briefly, the above embodiments are low cost and high speed voltage regulators. According to the present invention, by designing the voltage regulators as a one-stage negative feedback loop, the regulators can be operated under very high frequency. Moreover, by directly connecting the regulators to the output terminal of a power source, the headroom problem can be solved. In addition, by using a low impedance circuit to sense the high frequency variation on the output terminal, the voltage variation between the output terminal and the ground voltage is decrease.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A regulator, comprising:

a sensing circuit, arranged to sense a variation of a first reference voltage on an output terminal to generate a sensing signal; and a gain stage, arranged to adjust an adjusting current to the output terminal in response to the sensing signal for reducing the variation of the first reference voltage to regulate the first reference voltage on the output terminal, and the gain stage is coupled in parallel to a loading circuit powered by the first reference voltage;

wherein when the sensing circuit senses a decrease of the first reference voltage, the sensing signal adjusts the adjusting current via the gain stage coupled in parallel to the loading circuit to increase the first reference voltage on the output terminal, and when the sensing circuit senses an increase of the first reference voltage, the sensing signal adjusts the adjusting current via the gain stage coupled in parallel to the loading circuit to decrease the first reference voltage on the output terminal;

wherein the sensing circuit comprises:

a current source, having a first terminal coupled to the output terminal, for generating a reference current;

a diode-connected transistor, having a drain terminal coupled to a second terminal of the current source to receive the reference current, and a source terminal coupled to a second reference voltage; and a capacitive circuit, having a first terminal coupled to the output terminal, and a second terminal coupled to a gate terminal of the diode-connected transistor;

wherein the drain terminal of the diode-connected transistor is coupled to the gate terminal of the diode-connected transistor, and the sensing signal is generated at the gate terminal of the diode-connected transistor.

2. The regulator of claim 1, wherein the sensing circuit has a terminal directly coupled to the output terminal for sensing the variation of the first reference voltage.

3. The regulator of claim 1, wherein the gain stage has a terminal directly coupled to the output terminal for providing the adjusting current to the output terminal.

4. The regulator of claim 1, wherein the output terminal is directly coupled to a power source for receiving the first reference voltage outputted by the power source.

5. The regulator of claim 1, wherein the sensing circuit is a high pass filter arranged for performing a high pass operation upon the variation of the first reference voltage to generate the sensing signal.

6. The regulator of claim 1, wherein the gain stage comprises a trans-conducting circuit arranged for converting the sensing signal in a way of voltage form into the adjusting current.

7. The regulator of claim 1, wherein the gain stage comprises:

a field-effect transistor (FET), having a gate terminal to receive the sensing signal, a drain terminal coupled to the output terminal, and a source terminal coupled to a second reference voltage.

8. The regulator of claim 1, wherein the output terminal is an output port for providing the first reference voltage to the loading circuit.

9. The regulator of claim 6, wherein the gain stage further comprises:

a protection circuit, coupled between the trans-conducting circuit and the output terminal, for inducing a voltage drop between the output terminal and the trans-conducting circuit.

10. A regulator, comprising:

a sensing circuit, arranged to sense a variation of a first reference voltage on an output terminal to generate a sensing signal; and a gain stage, arranged to adjust an adjusting current to the output terminal in response to the sensing signal for reducing the variation of the first reference voltage to regulate the first reference voltage on the output terminal, and the gain stage is coupled in parallel to a loading circuit powered by the first reference voltage;

wherein when the sensing circuit senses a decrease of the first reference voltage, the sensing signal adjusts the adjusting current via the gain stage coupled in parallel to the loading circuit to increase the first reference voltage on the output terminal, and when the sensing circuit senses an increase of the first reference voltage, the sensing signal adjusts the adjusting current via the gain stage coupled in parallel to the loading circuit to decrease the first reference voltage on the output terminal;

wherein the gain stage comprises:

a trans-conducting circuit, arranged for converting the sensing signal in a way of voltage form into the adjusting current and a protection circuit, coupled between the trans-conducting circuit and the output terminal, arranged for inducing a voltage drop between the output terminal and the trans-conducting circuit wherein the protection circuit comprises:

a first field-effect transistor, having a gate terminal coupled to the output terminal, a drain terminal coupled to the output terminal, and a source terminal coupled to the trans-conducting circuit.

11. The regulator of claim 10, wherein the trans-conducting circuit comprises:

a second field-effect transistor, having a gate terminal to receive the sensing signal, a drain terminal coupled to the source terminal of the first field-effect transistor, and a source terminal coupled to a second reference voltage.

12. The regulator of claim 11, wherein the first field-effect transistor is an I/O (Input/Output) device, the second field-effect transistor is a core device.

13. The regulator of claim 11, wherein a breakdown voltage of the second field-effect transistor is smaller than the breakdown voltage of the first field-effect transistor.

14. A regulating method, comprising:

sensing a variation of a first reference voltage on an output terminal to generate a sensing signal; and using a gain stage for adjusting an adjusting current to the output terminal in response to the sensing signal for reducing the variation of the first reference voltage to regulate the first reference voltage on the output terminal, and the gain stage is coupled in parallel to a loading circuit powered by the first reference voltage;

wherein when sensing a decrease of the first reference voltage, the sensing signal adjusts the adjusting current via the gain stage coupled in parallel to the loading circuit to increase the first reference voltage on the output terminal, and when sensing an increase of the first reference voltage, the sensing signal adjusts the adjusting current via the gain stage coupled in parallel to the loading circuit to decrease the first reference voltage on the output terminal;

wherein the step of sensing the variation of the first reference voltage on the output terminal to generate the sensing signal comprises:

providing a current source to generate a reference current;

providing a diode-connected transistor having a drain terminal to receive the reference current, and a source terminal coupled to a second reference voltage; and providing a capacitive circuit having a first terminal coupled to the output terminal, and a second terminal coupled to a gate terminal of the diode-connected transistor;

wherein the drain terminal of the diode-connected transistor is coupled to the gate terminal of the diode-connected transistor.

15. The regulating method of claim 14, wherein the output terminal is directly coupled to a power source for receiving the first reference voltage outputted by the power source.

16. The regulating method of claim 14, wherein the step of sensing the variation of the first reference voltage on the output terminal to generate the sensing signal comprises:

performing a high pass operation upon the variation of the first reference voltage to generate the sensing signal.

17. The regulating method of claim 14, wherein the step of using the gain stage for providing the adjusting current to the output terminal in response to the sensing signal for reducing the variation of the first reference voltage comprises:

providing a first field-effect transistor having a gate terminal to receive the sensing signal, a drain terminal coupled to the output terminal, and a source terminal coupled to a second reference voltage.

18. A regulating method, comprising:

sensing a variation of a first reference voltage on an output terminal to generate a sensing signal; and using a gain stage for adjusting an adjusting current to the output terminal in response to the sensing signal for reducing the variation of the first reference voltage to regulate the first reference voltage on the output terminal, and the gain stage is coupled in parallel to a loading circuit powered by the first reference voltage;

wherein when sensing a decrease of the first reference voltage, the sensing signal adjusts the adjusting current via the gain stage coupled in parallel to the loading circuit to increase the first reference voltage on the output terminal, and when sensing an increase of the first reference voltage, the sensing signal adjusts the adjusting current via the gain stage coupled in parallel to the loading circuit to decrease the first reference voltage on the output terminal;

wherein the step of using the gain stage for providing the adjusting current to the output terminal in response to the sensing signal for reducing the variation of the first reference voltage comprises:

providing a first field-effect transistor having a gate terminal to receive the sensing signal, a drain terminal coupled to the output terminal, and a source terminal coupled to a second reference voltage; and providing a second field-effect transistor having a gate terminal coupled to the output terminal, a drain terminal coupled to the output terminal, and a source terminal coupled to the drain terminal of the first field-effect transistor.

19. The regulating method of claim 18, wherein the first field-effect transistor is a core device, the second field-effect transistor is an I/O (Input/Output) device.

20. The regulating method of claim 18, wherein a breakdown voltage of the first field-effect transistor is smaller than the breakdown voltage of the second field-effect transistor.

21. A regulator, comprising:

a sensing circuit, arranged to sense a variation of a first reference voltage on an output terminal to generate a sensing signal; and a gain stage, arranged to adjust an adjusting current to the output terminal in response to the sensing signal for reducing the variation of the first reference voltage to regulate the first reference voltage on the output terminal, and the gain stage is coupled in parallel to a loading circuit powered by the first reference voltage;

wherein when the sensing circuit senses a decrease of the first reference voltage, the sensing signal adjusts the adjusting current to increase the first reference voltage on the output terminal, and when the sensing circuit senses an increase of the first reference voltage, the sensing signal adjusts the adjusting current to decrease the first reference voltage on the output terminal;

wherein the sensing circuit comprises:

a current source, having a first terminal coupled to the output terminal, for generating a reference current;

a diode-connected transistor, having a drain terminal coupled to a second terminal of the current source to receive the reference current, and a source terminal coupled to a second reference voltage; and a capacitive circuit, having a first terminal coupled to the output terminal, and a second terminal coupled to a gate terminal of the diode-connected transistor;

wherein the drain terminal of the diode-connected transistor is coupled to the gate terminal of the diode-connected transistor, and the sensing signal is generated at the gate terminal of the diode-connected transistor.

* * * * *